United States Patent [19]

Blum

[11] 4,159,586

[45] Jul. 3, 1979

[54] MULTILAYERED LABELING SYSTEM

[76] Inventor: Julian J. Blum, 7211 N. 3rd St., Phoenix, Ariz. 85020

[21] Appl. No.: 833,474

[22] Filed: Sep. 15, 1977

[51] Int. Cl.[2] ..... A44C 3/00

[52] U.S. Cl. ..... 40/2 R

[58] Field of Search ..... 40/2 R, 310, 306

[56] References Cited

U.S. PATENT DOCUMENTS

| | | | |
|---|---|---|---|
| 2,671,678 | 3/1954 | Walsh | 40/2 R X |
| 2,682,721 | 7/1954 | Harris | 40/2 R |
| 2,767,495 | 10/1956 | Harris | 40/2 R |
| 2,953,865 | 9/1960 | Heuser | 40/2 R |
| 3,153,868 | 10/1964 | Jones | 40/2 R |

*Primary Examiner*—Louis G. Mancene

*Assistant Examiner*—Wenceslao J. Contreras

*Attorney, Agent, or Firm*—Cahill, Sutton & Thomas

[57] ABSTRACT

A labeling system is disclosed incorporating several layers. A transparent cover sheet is provided with an inside surface having pressure-sensitive adhesive thereon; a removable separator sheet releasably contacts the pressure-sensitive adhesive. A label is provided with an information surface for receiving information and a back surface having pressure-sensitive adhesive thereon. A removable backing sheet releasably contacts the pressure-sensitive adhesive on the back of the label. The several sheets are arranged in a multilayered structure wherein the transparent cover sheet is releasably secured along one edge thereof to the backing sheet and is secured adjacent the edge to the label.

4 Claims, 7 Drawing Figures

MULTILAYERED LABELING SYSTEM

The present invention relates to labels, and more particularly, to a labeling system incorporating pressure-sensitive adhesive.

Labels having pressure-sensitive adhesive or labels frequently referred to as "gummed labels" are well known. A great variety of such labels exist in the prior art; however, in many instances, it is desirable to utilize a gummed or self-adhering label and to provide a covering for the label after it is placed on a mounting surface. For example, it is frequently desirable to place a label on a mounting surface, place desired information on the label, and then cover the label with a transparent cover to prevent defacement or destruction of the label through subsequent use; such combinations are particularly useful in moist environments where it is desirable to protect the face of the label from the intrusion of moisture during label use.

The use of prior art labeling systems has required that lables with pressure-sensitive adhesive thereon or gummed labels be appropriately marked for use and then placed on a supporting surface; subsequently, a coating or clear plastic layer must then be placed on top of the label to protect it during use. Such techniques require multiple operations as well as careful alignment of the covering layer over the label after the label is in place to insure that the label is completely covered.

It is therefore an object of the present invention to provide a multilayered labeling system that may be utilized in those environments wherein the label is to be covered after information has been placed thereon.

It is also an object of the present invention to provide a multilayered labeling system that is conveniently used and inherently provides proper alignment of the several layers.

It is still another object of the present invention to provide a multilayered labeling system incorporating pressure-sensitive adhesive and transparent layers as well as a label layer that provides a surface for receiving information.

Briefly, in accordance with the embodiment chosen for description, a multilayered labeling system is provided through the utilization of a transparent cover sheet having an inside and an outside surface, and having a pressure-sensitive adhesive on the inside surface. A removable separator sheet is releasably positioned over and in contacting relationship with the pressure-sensitive adhesive on the inside surface of the transparent cover. A label, having an information surface facing the separator sheet, is provided and is also coated on the back surface thereof with a pressure-sensitive adhesive. A removable backing sheet is releasably secured to the back surface of the label. The transparent cover sheet incorporates a height and width that is larger than the label while the removable separator sheet attached to the transparent cover sheet is foreshortened so that the transparent cover sheet is releasably secured along one edge thereof to the backing sheet and secured adjacent that one edge to the label. The resulting multilayered structure therefore forms a unitary labeling system providing a means for receiving information on a labeling surface while permitting the label to be conveniently attached to a supporting surface and also permitting a transparent sheet to be readily and accurately positioned over the label by simply removing the releasably attached separator sheet.

The present invention may more readily be described by reference to the accompanying drawings in which.

FIGS. 4, 5, 6, and 7 are successive views of a multilayered labeling system constructed in accordance with the teachings of the present invention showing successive stages in the use of the system.

Figure 1:
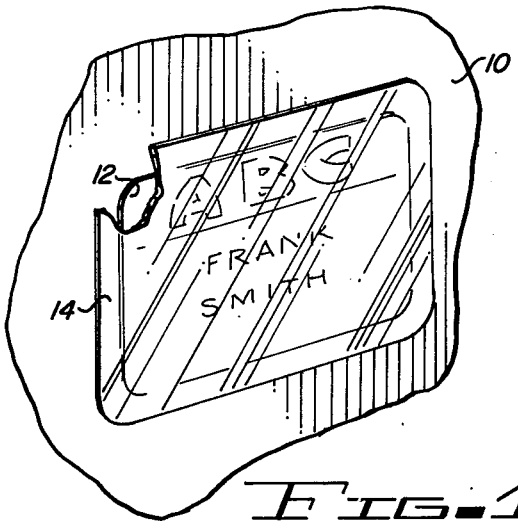
FIG. 1 is a perspective view, partly broken away, of a multilayered labeling system constructed in accordance with the teachings of the present invention and showing the label as it appears after it has been mounted on a supporting surface.
Figure 2:
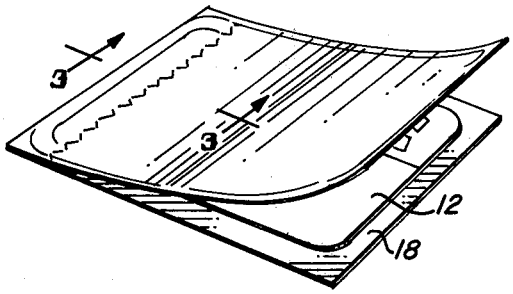
FIG. 2 is a perspective view of a multilayered labeling system constructed in accordance with the teachings of the present invention.
Figure 3:
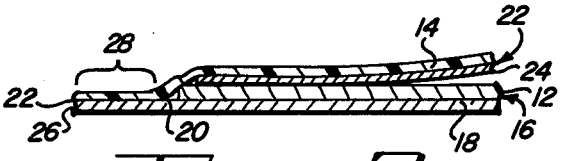
FIG. 3 is a partial cross-sectional view of FIG. 2 taken along lines 3—3.

As used herein, the term "pressure-sensitive adhesive" is intended to mean conventional tacky coatings typically used on paper products to permit a user to secure one sheet of paper to another; similarly, the term also is intended to include equivalent adhesives such as conventional paper "gummed" surfaces whether premoistened or not. Referring now to the drawings, and particularly to FIG. 1, a supporting surface 10 is shown having a label 12 adhesively secured thereto such as by a pressure-sensitive adhesive coating on the back of the label. A transparent cover sheet 14 is also secured to the supporting surface 10 and not only covers the label 12 but extends beyond the edges of the label to insure the "encasement" of the label to prevent the intrusion of dirt, moisture, etc. Referring now to FIGS. 2 and 3, the multilayered system of the present invention is shown prior to its use. The label 12 incorporates a pressure-sensitive adhesive layer 16 that is covered by a removable backing sheet 18 releasably contacting the adhesive. The backing sheet 18 extends beyond the edge 20 of the label 12. The transparent cover sheet 14 is also provided with pressure-sensitive adhesive 22 on the inside surface (the surface facing the label 12). The pressure-sensitive adhesive on the transparent cover sheet is covered by a removable separator sheet 24 that releasably contacts the pressure-sensitive adhesive and prevents it from adhering to or causing the adherence of the label 12 thereto. The transparent cover sheet 14 extends beyond the edge 20 of the label 12 and contacts the backing sheet 18 along one edge 26 thereof, and also contacts the label adjacent the edge 26 in the vicinity of the edge 20.

Thus, the multilayered structure presents a self-supporting unitary structure that may be handled without interfering with the usefulness or interfering with the function of the labeling system when it is to be used. It is interesting to note that the transparent cover sheet 14 and the removable separator sheet 24 secured by means of the pressure-sensitive adhesive 22 therebetween, may be folded back in a manner shown in FIG. 4 to expose the label 12, and particularly the information receiving surface of the label 12. When the top layers have been folded back as described above, the labeling system may conveniently be placed in a typewriter so that information may be typed on the surface of the label; similarly, other information may simply be written or otherwise placed on the information receiving surface. Further, the label may, of course, contain pre-printed information in accordance with present labeling techniques.

Figure 4:
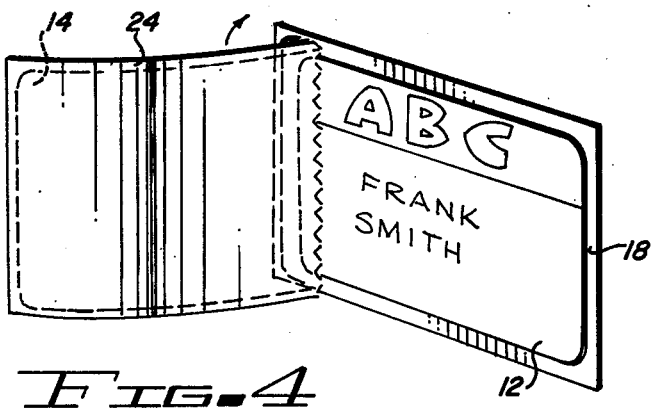
Figure 7:
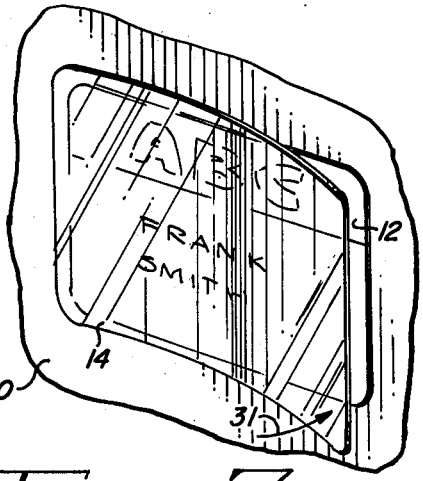
Figure 5:
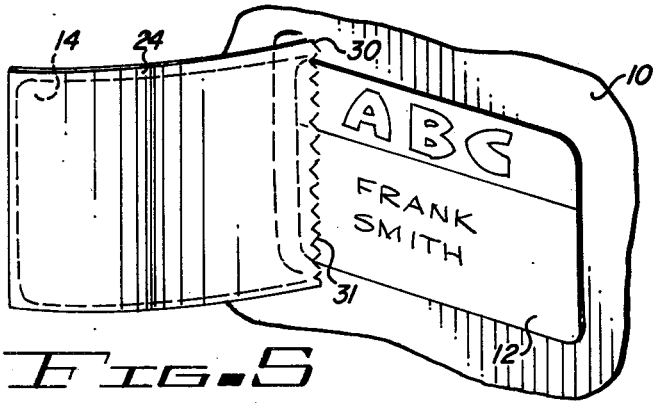

When the information is placed on the information receiving surface of the label 12, the labeling system will appear similar to that as shown in FIG. 4. The removable backing sheet 18 is then removed from the label so that the label may be placed on the desired supporting surface 10 as shown in FIG. 5. It may be noted that when the removable backing sheet 18 is removed from the label 12, the pressure-sensitive adhesive on the back surface of the label is exposed; further, removal of the backing sheet will also expose the pressure-sensitive adhesive 22 on the inside surface of the transparent cover sheet 14 in the area generally designated at 28 in FIG. 3. Thus, when the label 12 is placed on the chosen supporting surface 10, the label adheres to that surface; however, the portion of the exposed pressure-sensitive adhesive 22 on the transparent cover sheet 14 (area 28) also adheres to the supporting surface 10. It may also be noted that even though the backing sheet 18 is removed, the remaining layers and sheets nevertheless remain a unitary structure so that the relative positioning of the label 12 and the transparent cover sheet remains fixed.

When the label is in the position shown in FIG. 5, the removable separator sheet 24 may be grasped at its inner edge 30 and "peeled" from the inside surface of the transparent cover sheet 14. The inner edge 31 of the separator sheet 24 may conveniently be cut in a saw-toothed pattern to facilitate the separator sheet being grasped to be removed from the transparent cover sheet.

Figure 6:
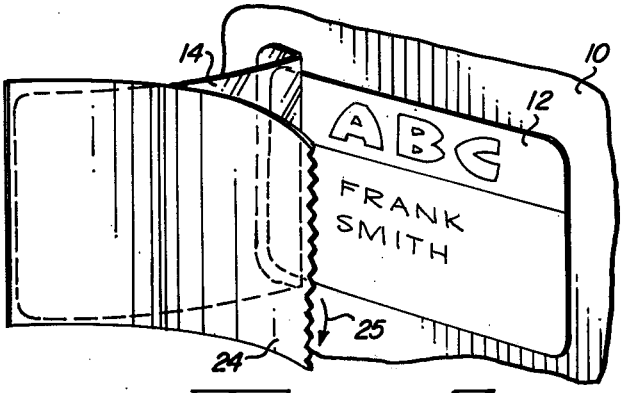

As the separator sheet is removed from the transparent cover sheet 14, the labeling system will appear as shown in FIG. 6. It may be seen that as the separator sheet 24 is removed as indicated by the arrow 25, the transparent cover sheet 14 remains in secure and fixed relationship with respect to the label 12. When the separator sheet 24 has been completely removed from the transparent cover sheet 14, the pressure-sensitive adhesive layer 22 on the inside surface of the transparent cover sheet is exposed and the cover sheet may then be folded over or rolled onto the label as indicated by the arrow 31 in FIG. 7. It is important to note that as the transparent cover sheet 14 is placed over the label 12, the relative position of the two is fixed since the left-hand (in FIG. 7) edge of the cover sheet was fixed simultaneously with the label 12 when the label was placed on the supporting surface 10. Thus, the cover sheet remains in perfect alignment with the label 12 and completely overlays the label to protect the label against dirt and moisture.

The multilayered labeling system of the present invention readily lends itself to present manufacturing techniques to thereby permit the labeling system to be produced with presently known, efficient manufacturing techniques. Further, present adhesives and materials may readily be used. As previously mentioned, the pressure-sensitive adhesive layers 22 and 16 may be formed of gum-type adhesives with the backing sheet 18 and separator sheet 24 merely acting as a gummed surface protector although it may be possible to eliminate a portion of the protective sheets. However, it has been found that conventional pressure-sensitive adhesives are most convenient and operate efficiently and effectively.

What is claimed is:

1. A multilayered labeling system comprising:

(a) a label having an information surface and a back surface, said back surface having a pressure-sensitive adhesive thereon;

(b) a removable backing sheet releasably contacting the pressure-sensitive adhesive on the back surface of said label, said backing sheet extending beyond said label along one edge of said label;

(c) a transparent cover sheet having an inside and an outside surface, and having a pressure-sensitive adhesive on said inside surface facing the information surface of said label, said transparent cover sheet extending beyond said label with the pressure-sensitive adhesive on the inside surface thereof releasably contacting said removable backing sheet along said one edge of said label, said transparent cover sheet also contacting the information surface of said label along said one edge; and (d) a removable separator sheet releasably contacting the pressure-sensitive adhesive on the inside surface of said transparent cover sheet.

2. The combination set forth in claim 1 wherein said transparent cover sheet is larger than said label and extends beyond said label on all sides.

3. The combination set forth in claim 1 wherein said separator sheet incorporates one side having a saw-toothed shaped edge to facilitate grasping said separator sheet to remove said sheet from said transparent cover sheet.

4. The combination set forth in claim 1 wherein said transparent cover sheet and removable separator sheet may be folded back out of contact with said label to form a flat structure that is readily insertable in a typewriter.

* * * * *